United States Patent [19]

Fueki et al.

[11] 3,951,760

[45] Apr. 20, 1976

[54] BATH FOR THE ELECTRODEPOSITION OF BRIGHT TIN-COBALT ALLOY

[75] Inventors: Shimetomo Fueki, Tokyo; Junichi Tada, Yokohama; Kenji Osawa, Hino; Naomi Sakai; Kazuhiro Ogawa, both of Yokohama, all of Japan

[73] Assignee: Sony Corporation, Tokyo, Japan

[22] Filed: Apr. 18, 1975

[21] Appl. No.: 569,448

Related U.S. Application Data

[62] Division of Ser. No. 360,542, May 15, 1973.

[30] Foreign Application Priority Data

| | | |
|---|---|---|
| May 17, 1972 | Japan | 47-48181 |
| May 17, 1972 | Japan | 47-48182 |
| May 17, 1972 | Japan | 47-48183 |
| May 17, 1972 | Japan | 47-48184 |

[52] U.S. Cl. ..... 204/43 S

[51] Int. Cl.$^2$ ..... C25D 3/60

[58] Field of Search ..... 204/43 S, 43 T, 123

[56] References Cited

OTHER PUBLICATIONS

V. Sree et al., Bull. India Sect. Electrochem. Soc., 9, 13–14, (1960).

Abner Brenner, "Electrodeposition of Alloys", Vol. II, pp. 339–341, (1963).

*Primary Examiner*—G. L. Kaplan

*Attorney, Agent, or Firm*—Lewis H. Eslinger; Allvin Sinderbrand

[57] ABSTRACT

A bright electroplated tin-cobalt alloy is obtained with an aqueous pyrophosphate electroplating bath which contains a brightening additive consisting of at least one organo-sulphur compound in combination with at least one member of the group consisting of ammonia, ammonium salts and amine compounds.

7 Claims, No Drawings

BATH FOR THE ELECTRODEPOSITION OF BRIGHT TIN-COBALT ALLOY

This is a division of application Ser. No. 360,542, filed May 15, 1973.

BACKGROUND OF THE INVENTION

1. Field of the Invention

The present invention relates generally to a bright tin-cobalt plating bath and more particularly to a bright tin-cobalt plating bath with an additive as a brightener.

2. Description of the Prior Art

In general, electroplated coatings of tin alloys have superior anti-corrosive characteristics. Tin-nickel alloy plating is one of the tin alloys that has been used and is superior in its anti-corrosive characteristic to a plating of tin or nickel alone. The tin-nickel alloy plating shows a reddish appearance. In order to carry out the tin-nickel alloy plating, an acidic fluoride bath is generally used, and the electroplated layer thus formed is very brittle and a crack is apt to be formed in the layer when stress is applied to it.

A pyrophosphate bath has been also proposed for the tin-nickel alloy plating but the thus formed electroplated layer is also brittle and it is more difficult to control the pyrophosphate bath than it is to control the acidic fluoride bath. For this reason, the pyrophosphate bath is not used in practice.

Tin-cobalt alloy plating is also known to avoid the undesirable brittleness of the tin-nickel alloy plating. The tin-cobalt alloy plating is substantially equal to the tin-nickel alloy plating in its anti-corrosive characteristic but is substantially better in its brittleness. In addition, cracks are not apt to form in the tin-cobalt alloy plating. As a practical plating bath, an acidic fluoride bath is used and the thus formed plating has a color equal to that of chromium plating. Therefore, the tin-cobalt alloy plating may be employed as a finishing plating in place of the chromium plating which is usually employed.

However, the tin-cobalt alloy plating bath including fluoride requires difficult drainage and exhaust treatments so that such a bath is undesirable from the point of view of environmental pollution.

A report (Electrodeposition of Alloys. Vol. 2, Academic Press, New York and London, pp. 339 – 341, 1963 edited by A. Brenner) has been issued by V. Sree and T. L. Rama Char on tin-cobalt alloy plating from a pyrophosphate bath. The inventors of the present invention have carried out a test based upon such report and in which ammonium citrate is added to the pyrophosphate bath as an additive, as disclosed in the report. Throughout this test, the contents of the bath were agitated to carry out a so-called Hull Cell Test. The electroplated coating formed by this test had black or grey blurs.

SUMMARY OF THE INVENTION

It is an object of the present invention to provide a bath for electrodeposition of bright tin-cobalt alloy which can produce a white bright tin-cobalt plating layer without the use of fluoride.

It is another object of the present invention to provide a brightener additive for an electrolyte consisting of stannous salt, cobalt salt and alkaline metal pyrophosphate.

DESCRIPTION OF THE PREFERRED EMBODIMENTS

In accordance with the present invention, the brightener additive consists essentially of at least one organosulphur compound in combination with at least one member of the group consisting of ammonia, ammonium salts and amine compounds.

In alloy plating bath including tin, cobalt and pyrophosphoric acid, tin pyrophosphate may be easily dissolved into an aqueous solution of potassium pyrophosphate, but cobalt pyrophosphate is hardly dissolved into the aqueous solution of potassium pyrophosphate diluted by 1–20 times at a temperature of 60°–80°C.

An electroplating bath according to the present invention is formed as follows 15 weight parts of potassium pyrophosphate are prepared for 1 weight part of cobalt metal; 40% aqueous cobalt salt solution is poured into potassium pyrophosphate water solution at about 60°C with agitation to be dissolved therein; and thereafter aqueous stannous pyrophosphate solution is poured into the thus prepared aqueous solution with agitation to be dissolved therein. The complex salt of the resulting alloy plating electrolyte is high in stability so that with the addition of the brightener, as hereinafter described in detail, a bright tin-cobalt alloy plating is obtained merely with mechanical agitation and without accompanying any void electrolyzing.

The cobalt salt is preferably selected from cobalt sulfate, cobalt nitrate, cobalt chloride, cobalt bromide, cobalt carbonate, cobalt acetate, ethylene diamine tetraacetic acid cobalt, cobalt (II) acetyl acetonate, cobalt (III) acetyl acetonate, glycine cobalt (III), and cobalt pyrophosphate.

The components of the electroplating bath according to the present invention are employed within the following concentration ranges: the stannous salt is present in the aqueous solution in an amount to provide 2 to 70 grams of stannous metal per liter of the aqueous solution; the cobalt salt is present in an amount to provide 1 to 40 grams of cobalt metal per liter of the aqueous solution, with the total concentration of the stannous and cobalt metals being less than 75 grams per liter of the aqueous solution; and the amount of alkali metal pyrophosphate is sufficient to provide more than 2 mols thereof for each mol of the total concentration of stannous and cobalt metals.

Among the organosulphur compounds which may be added to the plating electrolyte of the invention are dithioammelide, 4-amino-3,5-dimercapto-4,1,2-triazole ethylene thiuram monosulfide, 2.5-dimercapto-1,3,4-thiadiazole thiocarbohydrazide, hydrazodithiodicarbonamide, ethylene-bis-dithio-carbamic acid sodium salt and the like, in a concentration of 0.01–5 g/l.

The ammonia, ammonium salts and amine compounds which may be added to the plating electrolyte of the invention, are preferably from the group comprised of water solution of ammonia, ammonium chloride, ammonium citrate, ammonium tartrate, ammonium sulfate, ammonium acetate, ethylenediamine, 1,2-propanediamine, 1,3-propanediamine, 1,4-butanediamine, hydroxylamine hydrochloride, hydrazine, methylamine, ethylamine, propylamine, butylamine, piperazine, pyrrolidine, monoethanolamine, diethanolamine, and triethanolamine. The necessary amount of 28% aqueous solution of ammonia is 20–100 cc/l, that is 5.6 to 28.0 g/l considered as ammonia, and the necessary amount of the ammonium salts and amines compounds is 0.1–150 g/l.

The plating bath according to the present invention is 8.0–12.0 in pH, 20°–70°C in temperature and 0.1–4.0 A/dm² in current density. The plating with the plating bath of the invention is found to be effective when subjected to mechanical agitation, cathode rocking or a combination thereof.

The bright tin-cobalt alloy plating formed by the plating bath of the present invention has an appearance similar to that of chromium plating and is superior in anti-corrosive characteristic, so that even if it has been exposed to atmosphere for about 30 days no color change occurs and corrosion does not appear at the portions thereof with which human fingers have been in contact. Further, even if a brine solution is sprayed against the plated layer formed by the invention for about 72 hours, no changes occur. When the test piece having the plated layer thereon according to this invention is repeatedly bent up and down by about 90° through a tester with 4mm bending radius, the plated layer is not peeled off the test piece or powdered. The hardness of the plating is on the order of 500 on the Vicker's hardness scale.

electroplating can be used as both a finishing and a base plating.

4. The electroplating is very smooth at its marginal edge and even if the electroplating has thickness of 1–3 microns on a nonconductive material base with a relatively low current density of 0.1–1 amperes/dm², the electroplating has high anti-corrosive characteristics and a fine appearance. The electroplating is suited for those applications where chromium plating can not be employed.

5. The electroplating can be applied to electronic parts, acoustic devices, optical devices, precision apparatus, parts for automobiles and ornaments.

It will be apparent that many variations and changes may be effected without departing from the spirit and scope of the novel concepts of the present invention.

We claim as our invention:

1. A bright tin-cobalt alloy electroplating bath consisting essentially of an aqueous alkaline solution of:

a. a stannous salt present in an amount sufficient to provide from 2 to 70 grams of stannous metal per liter of said solution;

b. a cobalt salt present in an amount sufficient to provide from 1 to 'grams of cobalt metal liter of said solution, with the total amount of said stannous and cobalt metals being less than 75 grams per liter of said solution;

c. an alkali metal pyrophosphate present in an amount providing more than two mols thereof for each mol of said total amount of said stannous and cobalt metals; and d. a brightener additive consisting of at least one organo-sulphur compound and at least one substance selected from the group consisting of ammonia, ammonium salts and amine compounds, said organo-sulphur compound being present in an amount of approximately 0.01 to 5.0 grams per liter of said solution, and said selected substance being present in an amount of approximately 5.6 to 28.0 grams per liter of said solution, when said substance is ammonia, and approximately 0.1 to 150 grams per liter of said solution, when said selected substance is selected from said ammonium salts and amine compounds.

| | | Example | | | | | | |
|---|---|---|---|---|---|---|---|---|
| | | 1 | 2 | 3 | 4 | 5 | 6 | 7 |
| potassium pyrophosphate | g/l | 250 | 250 | 250 | 250 | 250 | 250 | 250 |
| tin pyrophosphate | g/l | 15 | 15 | 15 | 15 | 15 | 15 | 15 |
| cobalt chloride | g/l | 30 | 30 | 30 | | | | |
| cobalt sulfate | g/l | | | | 35 | | 35 | |
| cobalt acetate | g/l | | | | | 30 | | 30 |
| water solution of ammonia 28% | cc/l | 70 | | | | | 40 | |
| 1,3-propanediamine | cc/l | | 3 | 3 | 3 | | | |
| triethanolamine | cc/l | | | | | 1 | | 2 |
| dithioammelide | g/l | 0.6 | | | 0.8 | | | 0.5 |
| 4-amino-3,5-dimercapto-4, 1,2-triazole | g/l | | 0.8 | | | | | |
| hydrazodithiodicarbonamide | g/l | | | 0.8 | | 0.8 | 2 | 0.5 |
| pH | | 10.0 | " | " | " | " | " | " |
| Temperature | °C | 55 | " | " | " | " | " | " |
| Cathode rocker | | exist | " | " | " | " | " | " |
| current density | A/dm² | 0.5~2 | " | " | " | " | " | " |
| amount of contained educed tin | % | 80.3 | 80.7 | 79.8 | 80.9 | 80.1 | 80.3 | 80.8 |
| Appearance | | white bright | " | " | " | " | " | " |
| Anode | | carbon | " | " | " | " | " | " |

It will be apparent from the above Examples 1 to 7 that the bright tin-cobalt alloy plating formed in the pyrophosphate bath is obtained by using, as the additive, the combination of ammonia, an ammonium salt or an amine compound with an organosulphur compound, other than an amino acid with sulphur.

The advantages of the bright tin-cobalt plating electrolyte of the present invention are summarized as follows:

1. Drainage and exhaust treatments are easily achieved because fluoride is not used in the bath.
2. Electroplating is carried out at room temperature, which is not the case when using fluoride which requires temperature of 65°–90°C. Thus, electroplating according to the invention can be applied to plastics.
3. If the electroplating has a thickness of more than 10 microns, it shows an appearance similar to that of chromium plating and it is superior in anti-corrosive characteristic and not brittle. As a result, the 2. A bright tin-cobalt alloy electroplating bath according to claim 1; in which said organo-sulphur compound is selected from the group consisting of dithioammelide, 4-amino-3,5-dimercapto-4,1,2-triazole, ethylenethiuram-monosulfide, 2,5-dimercapto-1,3,4-thiadiazolethiocarbohydrazide, hydrazodithiocarbonamide, and ethylene-bis-dithiocarbamic acid sodium salt.

3. A bright tin-cobalt alloy electroplating bath according to claim 2; in which said ammonium salts are selected from the group consisting of ammonium chloride, ammonium citrate, ammonium tartrate, ammonium sulfate and ammonium acetate.

4. A bright tin-cobalt alloy electroplating bath according to claim 3; in which said amine compounds are selected from the group consisting of ethylenediamine, 1,2-propanediamine, 1,3-propanediamine, 1,4-butanediamine, hydroxylamine-hydrochloride, hydrazine, methylamine, ethylamine, propylamine, butylamine, piperazine, pyrrolidine, monoethanolamine, diethanolamine, and triethanolamine.

5. A bright tin-cobalt alloy electroplating bath according to claim 2; in which said stannous salt is tin (II) pyrophosphate.

6. A bright tin-cobalt alloy electroplating bath according to claim 2; in which said cobalt salt is selected from the group consisting of cobalt sulfate, cobalt nitrate, cobalt chloride, cobalt bromide, cobalt carbonate, cobalt acetate, ethylene-diamine tetraacetic acid cobalt, cobalt (II) acetyl acetonate, cobalt (III) acetyl acetonate, glycine cobalt (III) and cobalt pyrophosphate.

7. A bright tin-cobalt alloy electroplating bath according to claim 2; in which said alkali metal pyrophosphate is potassium pyrophosphate.

* * * * *